US009480876B1

(12) United States Patent
Blacklock

(10) Patent No.: US 9,480,876 B1
(45) Date of Patent: Nov. 1, 2016

(54) ADJUSTABLE WEIGHT TRAINING/THERAPY DEVICE

(71) Applicant: Craig Blacklock, Jenks, OK (US)

(72) Inventor: Craig Blacklock, Jenks, OK (US)

( * ) Notice: Subject to any disclaimer, the term of this patent is extended or adjusted under 35 U.S.C. 154(b) by 96 days.

(21) Appl. No.: 14/031,539

(22) Filed: Sep. 19, 2013

(51) Int. Cl.
*A63B 23/14* (2006.01)
*A63B 23/16* (2006.01)
*A63B 23/12* (2006.01)

(52) U.S. Cl.
CPC ..... *A63B 23/12* (2013.01)

(58) Field of Classification Search
CPC ..... A63B 15/00; A63B 23/14; A63B 23/16; A63B 23/12; A63B 23/1281; A63B 21/072; A63B 21/0618; A63B 2021/0722; A63B 15/005; A63B 21/0724; A63B 21/075; A63B 21/08; A63B 21/4033; A63B 21/4035; A63B 49/035; A45B 3/00
USPC ..... 482/20, 44, 45, 46, 49, 50, 92, 93, 106, 482/107, 109; D21/662; 601/33, 40
See application file for complete search history.

(56) References Cited

U.S. PATENT DOCUMENTS

| | | | | | |
|---|---|---|---|---|---|
| 588,350 | A * | 8/1897 | Perkins | 482/109 |
| 1,658,108 | A * | 2/1928 | Vaughn | 482/109 |
| 2,470,816 | A * | 5/1949 | Harvey | 482/109 |
| 3,422,719 | A * | 1/1969 | Payson | 84/422.4 |
| 3,521,883 | A | 7/1970 | Hamilton | |
| 3,637,205 | A | 1/1972 | Bankston | |
| 3,690,655 | A | 9/1972 | Chapman | |
| 4,634,121 | A | 1/1987 | Sasaki | |
| 4,664,373 | A | 5/1987 | Hait | |
| 4,809,975 | A * | 3/1989 | Lee | 482/110 |
| 4,973,043 | A * | 11/1990 | Nolan | 482/45 |
| 5,092,588 | A | 3/1992 | DeLuca | |
| 5,254,066 | A * | 10/1993 | Brown et al. | 482/137 |
| 5,281,192 | A * | 1/1994 | Nelson | 482/93 |
| 5,449,333 | A | 9/1995 | Carter | |
| 7,175,575 | B1 | 2/2007 | Dantolen | |
| D566,205 | S | 4/2008 | Oates | |
| 7,618,328 | B2 * | 11/2009 | Davenport et al. | 473/257 |
| 2004/0009826 | A1 * | 1/2004 | Aisenberg | 473/256 |
| 2010/0248867 | A1 * | 9/2010 | Tande | 473/457 |

* cited by examiner

*Primary Examiner* — Loan H Thanh
*Assistant Examiner* — Nyca T Nguyen
(74) *Attorney, Agent, or Firm* — Head, Johnson & Kachigian, P.C.

(57) ABSTRACT

An adjustable, customizable device for use in physical therapy and/or strength training. The device may have a rail; a handle; a weight, where the weight may be adjustably positioned along the rail and held in place against the rail via an attachment device; and a stop located on the rail adjacent the handle, such that the stop prevents the weight from coming into contact with the handle. When the device is held by the handle, the weight provides increased force the further the weight is located from the handle due to the cantilevered nature of the device. Thus, the amount of force used in various exercises can be adjusted by moving the weight along the rail, either between different types of exercises or as the user's strength increases. Different sizes and shapes of handles may be utilized to accommodate the user's hand size and exercise goals.

14 Claims, 4 Drawing Sheets

ADJUSTABLE WEIGHT TRAINING/THERAPY DEVICE

CROSS REFERENCE

Not Applicable.

BACKGROUND OF THE INVENTION

1. Field of the Invention

This invention relates generally to a training/therapy device, and more particularly, but not by way of limitation, to an adjustable, multi-purpose device for training and/or physical therapy of fingers, hands, arms, and/or shoulders.

2. Description of the Related Art

A variety of devices are used in both physical therapy and strength training for improving the strength of a user's hands, arms, and shoulders. Each of these areas of the body has different requirements, however, and thus typically requires the use of a different device for strengthening that area. Likewise, different devices are often required for physical therapy than for strength training, as physical therapy patients typically have suffered injuries and are attempting to regain normal function of their hands, arms, and/or shoulders, while those seeking strength training typically have at least normal function, in beginners, to significant strength already, in athletes, and thus require greater resistance and/or higher difficulty exercise to reach their goals compared to physical therapy patients. In both fields, there are few options for exercising a user's fingers, particularly the fingertips.

Based on the foregoing, it is desirable to provide a single device that can be customized for appropriate use for either physical therapy or strength training.

It is further desirable to provide such a device that can be adjusted as a user's strength improves, providing greater resistance incrementally as desired.

It is further desirable to provide such a device that can be adjusted to accommodate different user's hand sizes.

It is further desirable to provide such a device that engages the user's fingertips in such a way as to strengthen the user's fingertips.

SUMMARY OF THE INVENTION

In general, in a first aspect, the invention relates to a device comprising: a rail with a first end and a second end; a handle attached to the first end of the rail; a weight, where the weight may be adjustably positioned along the rail and held in place against the rail via an attachment device; and a stop located on the rail adjacent the handle, such that the stop prevents the weight from coming into contact with the handle.

The handle may be removably attached to the first end of the rail. The handle may have a threaded bore and the first end of the rail may be threaded such that the handle may be removably attached to the first end of the rail by screwing the handle onto the rail. The handle may be puck shaped or ball shaped, or any other appropriate shape.

The device may further comprise a rail cap located at the second end of the rail such that the rail cap prevents the weight from sliding off the second end of the rail. The stop may be rubber or other elastomeric material. The stop may be cylindrical with a longitudinal bore therethrough such that the rail fits within the bore. The device may further comprise a plurality of markings along the rail indicating how much force is exerted by the weight when supported at the handle.

The weight may be cylindrical with a longitudinal bore therethrough such that the rail fits within the bore. The weight may have a threaded hole extending from the weight's exterior to the bore, where the threaded hole runs perpendicular to the hole. The attachment device may be a screw appropriately sized to fit within the threaded hole such that it may be tightened to press against the rail, thus securing the weight in a desired position relative to the rail, or loosened to allow the weight to slide along the rail to a desired position.

The device may be part of a system, where the system comprises: a rail with a threaded first end and a second end; a stop located on the rail adjacent the threaded first end; a plurality of handles, each with a threaded bore such that any one of the plurality of handles may be attached to the threaded first end of the rail by screwing the handle onto the rail, where the handle abuts the stop when in place on the rail; and a plurality of weights, where any one of the plurality of weights may be adjustably positioned along the rail and held in place against the rail via an attachment device. The stop may be removable from the rail, and each of the plurality of weights may be cylindrical with a longitudinal bore therethrough such that the rail fits within the bore and the weight is slidable along the rail when not secured in place via the attachment device. Thus, the system may be capable of being used to produce a customized exercise device by removing the stop from the rail, sliding one of the weights onto the rail, replacing the stop back onto the rail, screwing one of the handles onto the first end of the rail, sliding the weight to a desired position along the rail, and securing the weight to the rail in the desired position via the attachment device. Each of the plurality of weights may have a different weight. The plurality of handles may comprise at least one puck shaped handle and at least one ball shaped handle, and each of the plurality of handles may be a different size such that the plurality of handles can accommodate a plurality of hand sizes. The system may further comprise a rail cap located at the second end of the rail such that the rail cap prevents the weight from sliding off the second end of the rail.

The device may be used in a method of exercise, the method comprising: adjusting the device, where adjusting the device comprises adjusting the position of the weight along the rail and securing the weight in position via the attachment device; holding the device via the handle; performing exercises with the device; increasing the force exerted by the device by loosening the attachment device, sliding the weight along the rail away from the handle to a new position, and securing the weight in the new position via the attachment device; and performing further exercises with the device.

Other advantages and features will be apparent from the following description and from the claims.

DETAILED DESCRIPTION OF THE INVENTION

The devices and methods discussed herein are merely illustrative of specific manners in which to make and use this invention and are not to be interpreted as limiting in scope.

While the devices and methods have been described with a certain degree of particularity, it is to be noted that many modifications may be made in the details of the construction and the arrangement of the devices and components without departing from the spirit and scope of this disclosure. It is understood that the devices and methods are not limited to the embodiments set forth herein for purposes of exemplification.

Figure 1:
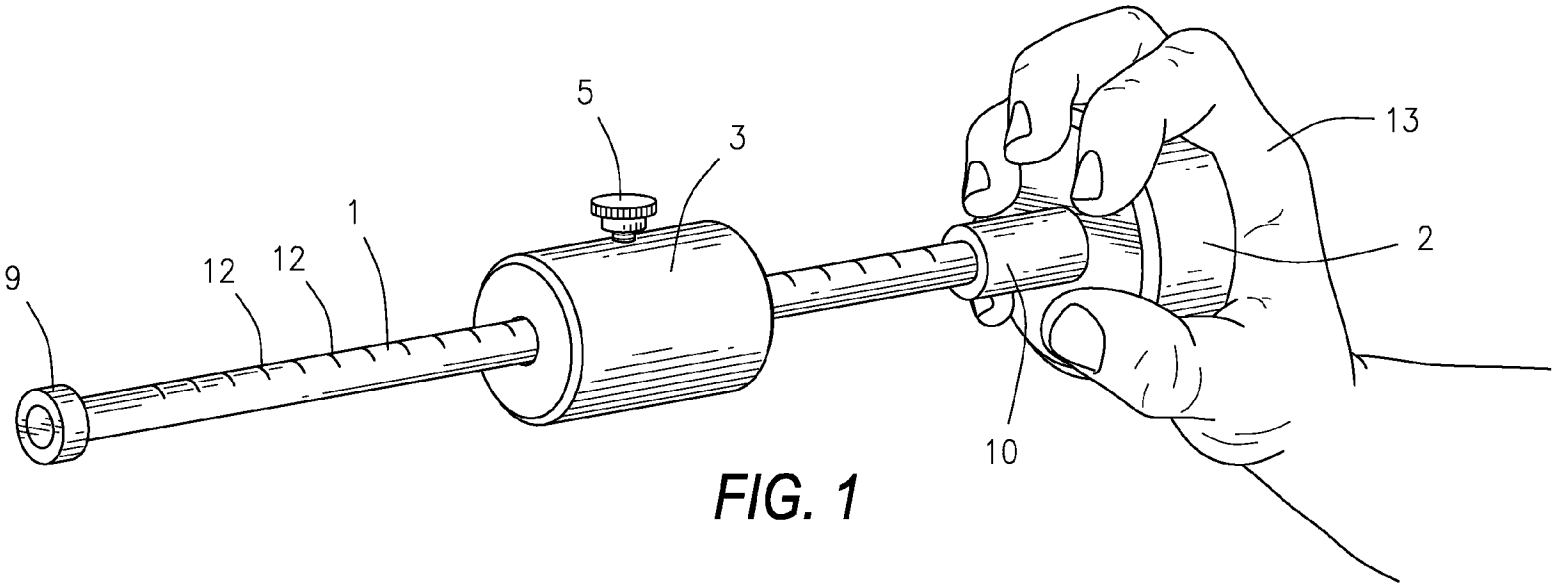
FIG. 1 is a perspective view of the device in use.

In general, in a first aspect, the invention relates to a device for use in physical therapy and/or training. As seen in FIG. 1, the device comprises a rail 1 with a handle 2 and a weight 3. The rail 1 may be cylindrical, as shown in the Figures, or any other desired shape.

Figure 2:
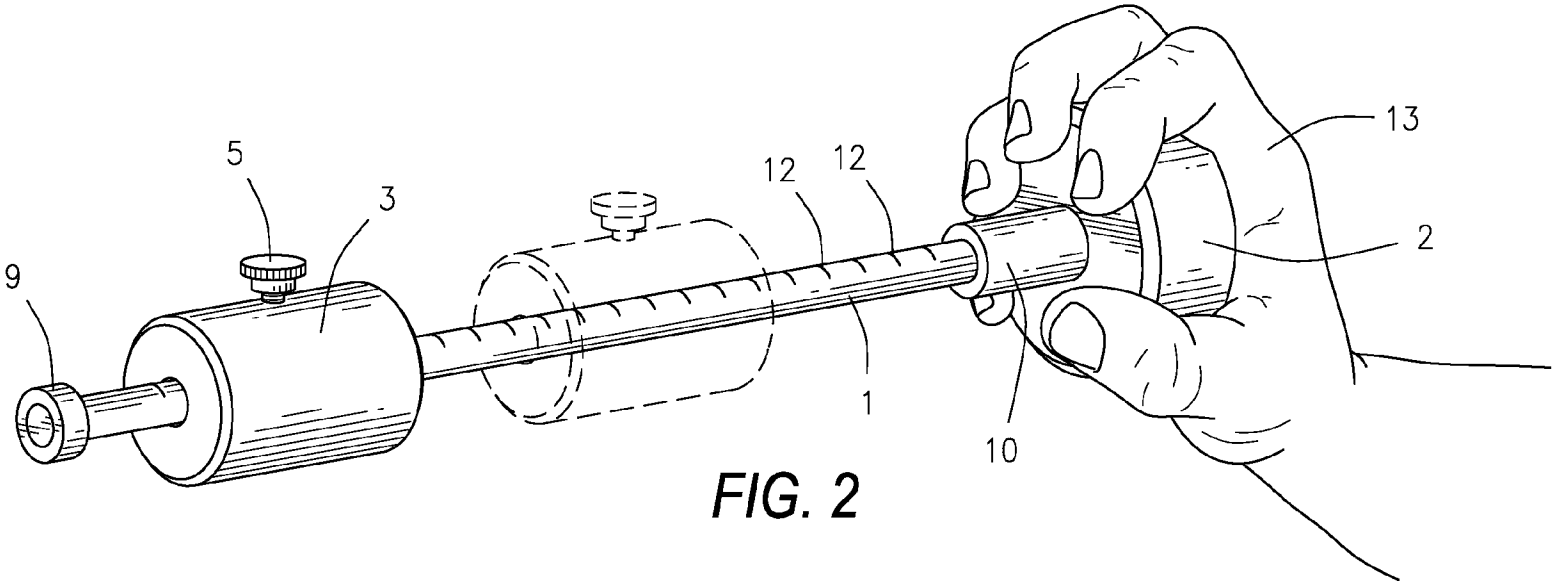
FIG. 2 is a perspective view of the device in use showing the weight in a different position.
Figure 4:
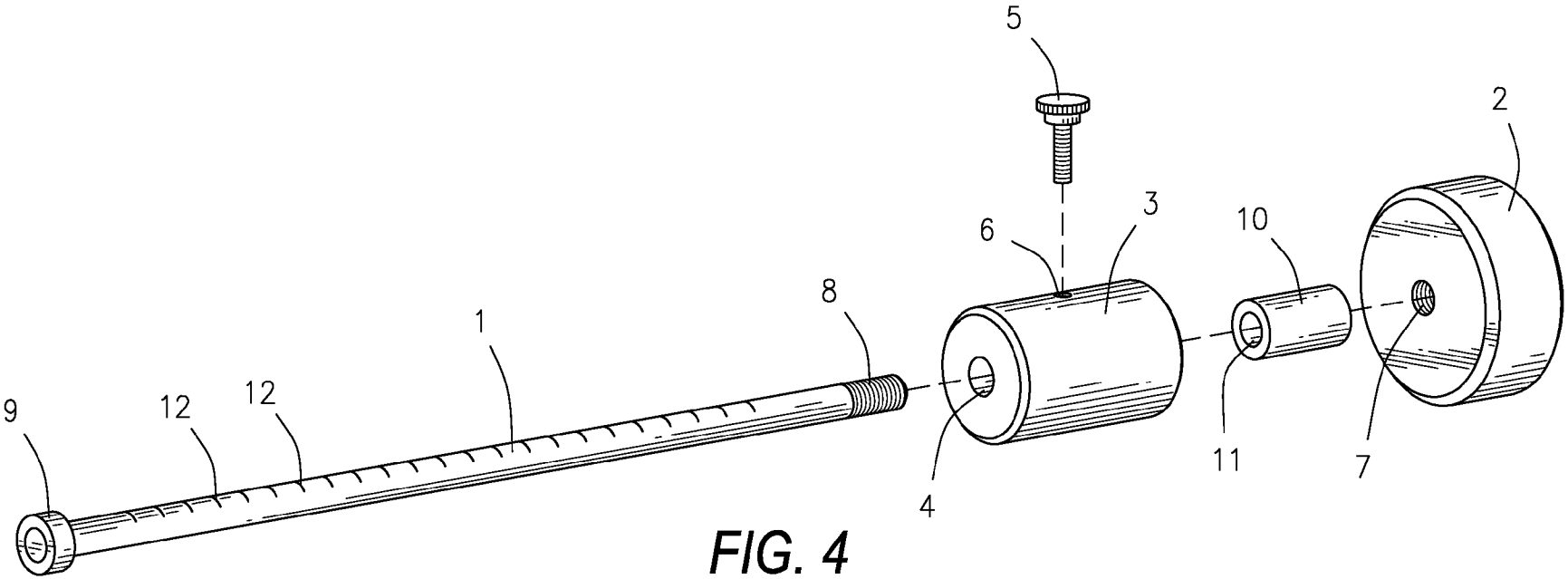
FIG. 4 is an exploded perspective view of the device.

The weight 3 may be slidable along the rail 1, such that it may be positioned as desired, as illustrated in FIG. 2. The weight 3 may be cylindrical or any other appropriate shape, with a longitudinal bore 4 extending therethrough, as seen in FIG. 4, through which the rail 1 may be placed. The weight 3 may slide freely along the rail 1 until it reaches a desired position, where it may be secured in place relative to the rail 1 via an attachment device 5. The attachment device 5 may be a screw, as shown in the Figures, or any other appropriate attachment device. If the attachment device 5 is a screw, it may extend through a hole 6 in the side of the weight 3 to abut the rail 1. When a user desires to adjust the position of the weight 3, the user may rotate the screw such that it backs away from the rail 1, allowing the weight 3 to move freely along the rail 1. Once the weight 3 is in a desired position, the user may rotate the screw such that it presses against the rail 1, thus securing the weight 3 in place relative to the rail 1. Alternately, the attachment device 5 may be a locking pin system with a pin that inserts through the sliding weight 3 into the rail 1, or any other suitable attachment device 5. The weight may be made of any appropriate material, including metals such as steel, stainless steel, titanium, copper, or lead, or other material such as rubber, plastics, polyurethane compositions, polyurea compositions, or other suitable material.

Figure 6:
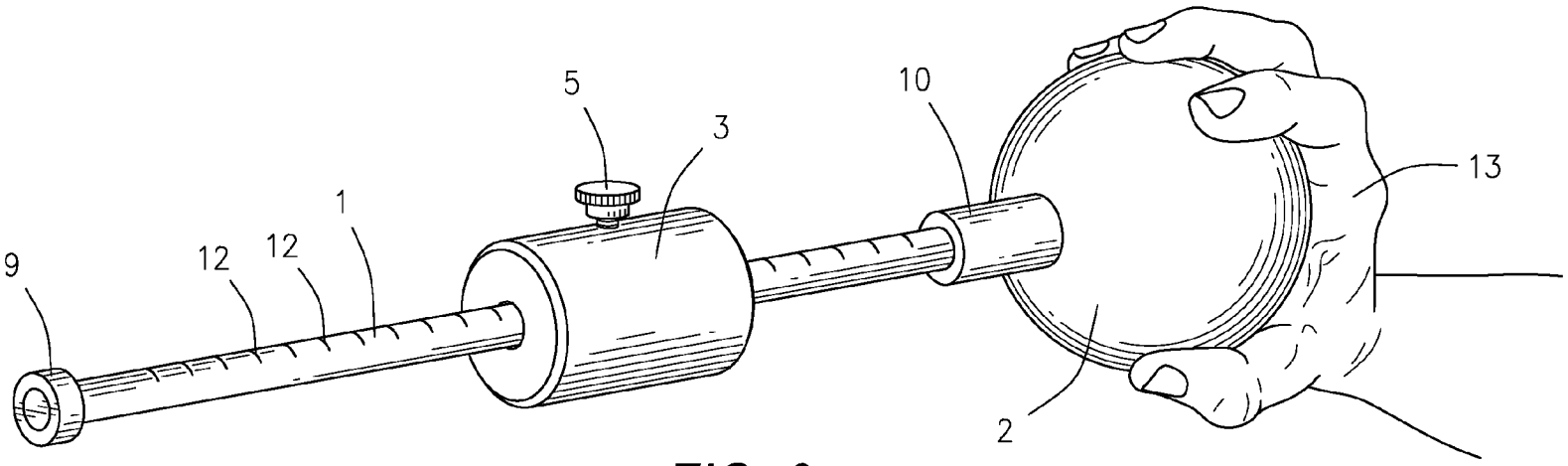
FIG. 6 is a perspective view of the device in use with the optional ball handle.
Figure 7:
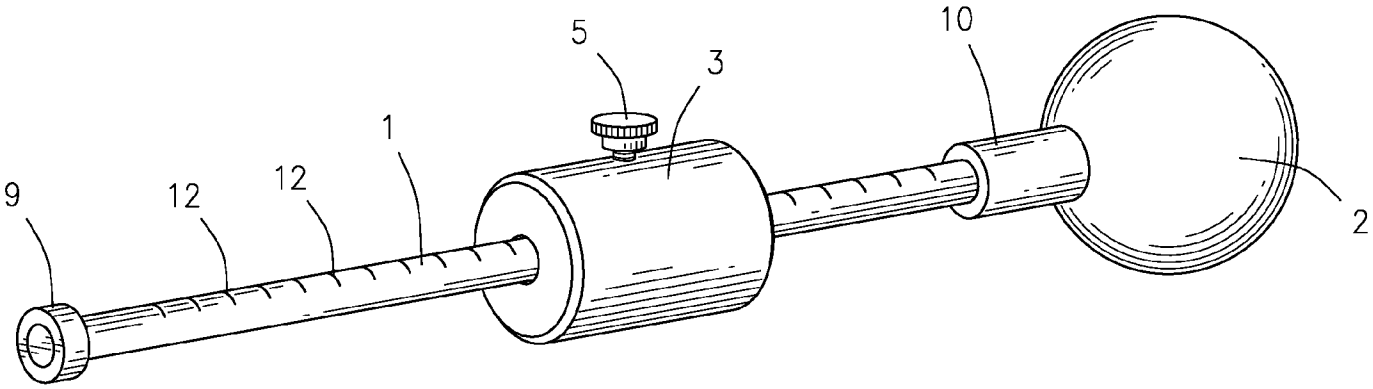
FIG. 7 is a perspective view of the device with the optional small ball handle.
Figure 8:
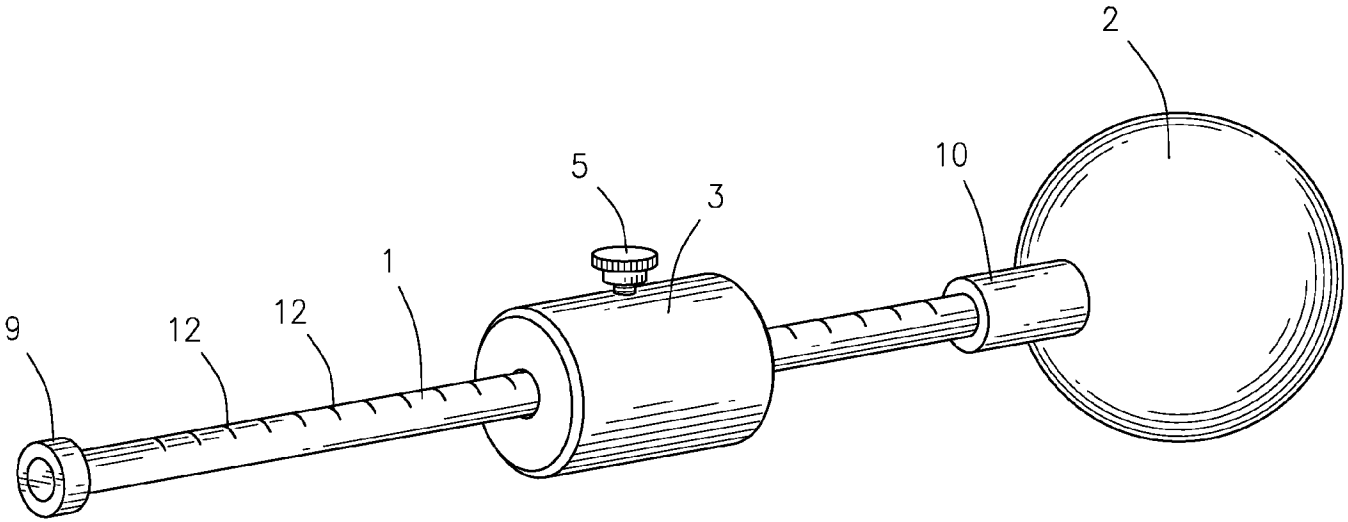
FIG. 8 is a perspective view of the device with the optional large ball handle.

The handle 2 may be located at one end of the rail 1 and may be attached in any suitable way. For example, the handle 2 may have a threaded bore 7 that corresponds to a threaded end 8 of the rail 1, as seen in FIG. 4, such that the handle 2 may be screwed onto the rail 1. The handle 2 may have any desired shape, such as a puck shape, as seen in FIGS. 1 through 5, or a ball shape, as seen in FIGS. 6 through 8. Other options include pear shaped, with the handle 2 thicker at the bottom and tapering down, becoming smaller as it reaches the point where the rail 1 attaches to the handle 2, or brass knuckle shaped, where a user may insert his or her fingers through the handle 2 and grip it, thus making a fist. The handle 2 may be any desired size, as discussed below, or color, and may be made of any desired material, including any metal, plastic, or other suitable material, such as steel, stainless steel, titanium, copper, lead, rubber, polyurethane compositions, polyurea compositions, etc.

The device may further comprise a rail cap 9 located at the end of the rail 1 opposite the threaded end 8. This cap 9 operates as a stop to prevent the weight 3 from sliding off the end of the rail 1. Similarly, the device may further comprise a stop 10 located on the rail 1 adjacent the handle 2 to prevent the weight 3 from sliding against the handle 2. This prevents potential injuries to a user's fingers should the weight 3 begin sliding while the device is in use. The stop 10 may be made of rubber or other resilient material, including plastics, polyurethane compositions, or polyurea compositions, or may be made of non-resilient material, such as brass, stainless steel, copper, or other metal. The stop 10 may be cylindrical or other suitable shape, with a bore 11 therethrough, as shown in FIG. 4, through which the rail 1 may extend. Additionally, the device may further comprise markings 12 at appropriate intervals to indicate the effective force of the weight 3 when placed at that location. The markings 12 may comprise etchings, grooves, notches, holes, printing, or other suitable markings.

Figure 3:
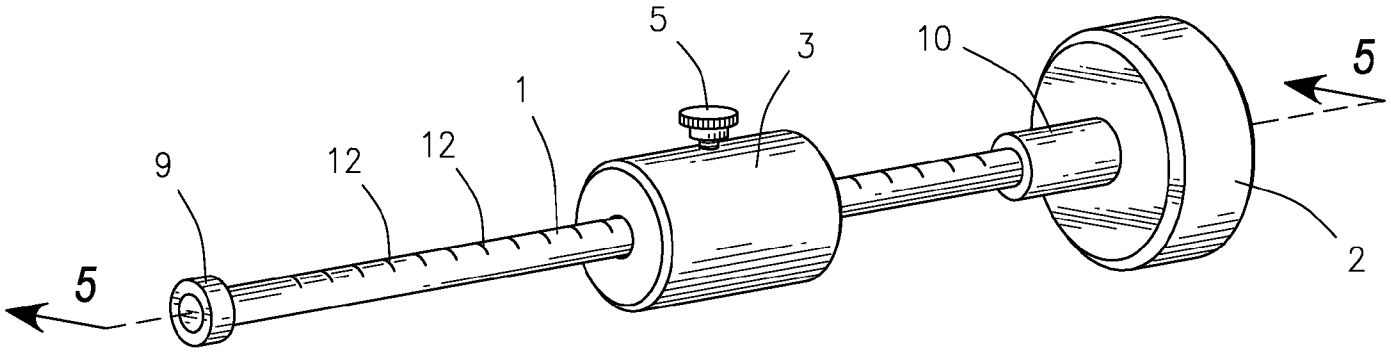
FIG. 3 is a perspective view of the device.
Figure 5:
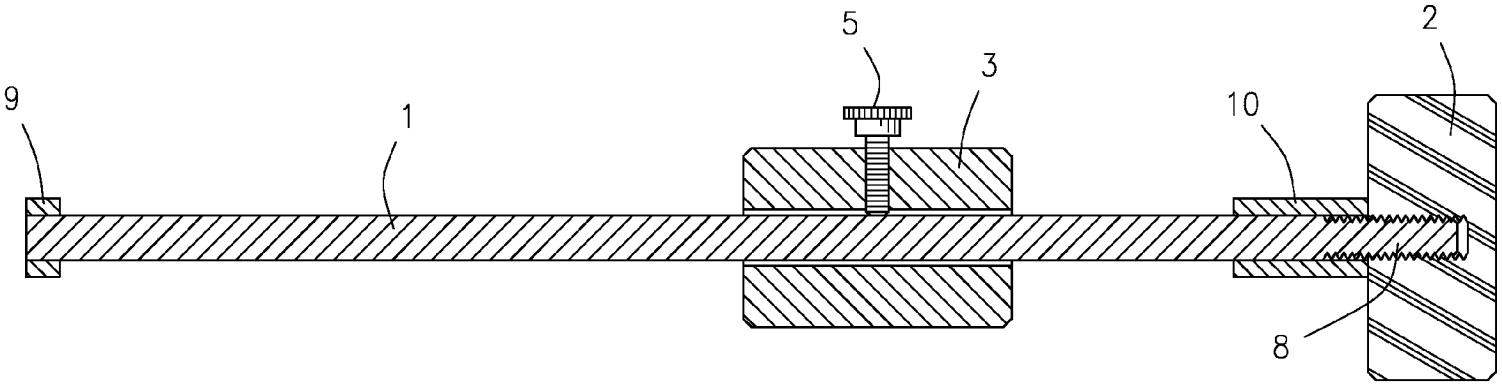
FIG. 5 is a cross sectional view of the device.

FIG. 3 shows the device fully assembled, with FIG. 5 showing a cross section thereof. The rail cap 9 may be located at one end of the rail 1, followed by the weight 3, which may be slid along the weight 3 for adjustment and secured in place via the attachment device 5. Next along the rail 1 may be the stop 10, which may be adjacent the handle 2 attached to the end of the rail 1.

In use, a user may hold the handle 2 with his or her hand 13, as shown in FIGS. 1 and 2, and may proceed to perform exercises for strengthening the user's fingers, hand, arm, and/or shoulder, as desired. Such exercises may be suggested by a physical therapist for rehabilitation of the user's fingers, hand, wrist, arm, elbow, or shoulder, as well as all primary and secondary muscles from the finger all the way up the arm to the shoulder, or by a trainer for strengthening of the same. The device can be used to build muscle, ligament strength, and/or tendon strength in isolated areas or across a broad spectrum. The exercises utilizing the device may be based on proper kinetic movements of the body and movements used in daily tasking or related to job skills. The exercises may be used to strengthen, increase movement, and/or increase range of motion. Notably, the device may be used to strengthen and increase the range of motion in the fingers and their individual parts, especially the flexor tendons, such as but not limited to the profundus. There is nothing currently in therapy that can isolate this area as well as the present device.

The location of the weight 3 along the rail 1 may determine the effective force of the device. Due to the cantilevered structure of the device, the effective force increases as the weight 3 is located further from the handle 2. Thus, a user may begin his or her exercise regime with the weight 3 located adjacent the stop 10, providing the least resistance for the exercises, and may move the weight 3 further from the handle 2 over time as his or her muscles improve and greater resistance is desired. The weight 3 may be offered in a variety of sizes, allowing the user to select an appropriate sized weight 3 for his or her training goals.

The shape of the handle 2 may impact which of the user's muscles are worked; thus, different shaped handles may be desirable for different exercise goals. The different shaped handles may be specific to the anatomy and kinetic movement of the hand, getting maximum strength and rehabilitation for all joints and ligaments of the hand. For example, the puck shaped handle 2 shown in FIGS. 1 through 5 may require greater use of the tips of the user's fingers, which is particularly desirable for those users who have suffered injuries to the tips of their fingers and are working on regaining full function thereof. This is also desirable for those users who wish to improve their grip strength, such as certain martial artists. The ball shaped handle 2 shown in FIGS. 6 through 8 works the user's fingers in different ways. This can also improve grip strength, and is particularly desirable for ball players, for example. Different users may have different size hands and thus may require different size handles 2. Thus, the handle 2 may be any desired size. For example, the puck shaped handle 2 may be selected in an appropriate size such that the user may comfortably grip the handle 2 with his or her first finger joints located at the edge of the top surface of the handle 2, as shown in FIGS. 1 and 2. The ball shaped handle may likewise be selected in an appropriate size for a user's hand and exercise goals, such as tennis ball size, as shown in FIG. 7, baseball size, as shown in FIG. 6, or softball size, as shown in FIG. 9.

The device may be provided to a user as part of a system comprising the device, a variety of sizes of weights 3, and a variety of sizes and shapes of handles 2. This allows the user and/or the user's physical therapist or trainer to customize the device to the user's hand size, current capabilities, and goals, and to progressively modify the device as desired as the user proceeds toward those goals.

Whereas, the devices and methods have been described in relation to the drawings and claims, it should be understood that other and further modifications, apart from those shown or suggested herein, may be made within the spirit and scope of this invention.

What is claimed is:

1. A device comprising:

a rail with a first end and a second end;

a handle attached to the first end of the rail, wherein the handle is puck shaped or ball shaped;

a weight, wherein the weight has a longitudinal bore therethrough such that the rail fits within the longitudinal bore and the weight is configured to be adjustably positioned along the rail and held in place against the rail via an attachment device; and a stop located on the rail adjacent the handle, such that the stop prevents the weight from coming into contact with the handle;

wherein the handle has a threaded bore and the first end of the rail is threaded such that the handle is configured to be removably attached to the first end of the rail by screwing the handle onto the rail;

and the weight has a threaded hole extending from the weight's exterior to the longitudinal bore, wherein the threaded hole runs perpendicular to the longitudinal bore; and the attachment device is a screw appropriately sized to fit within the threaded hole such that the attachment device is configured to be tightened to press against the rail, thus securing the weight in a desired position relative to the rail, or loosened to allow the weight to slide along the rail to a desired position.

2. The device of claim 1 wherein the handle is removably attached to the first end of the rail.

3. The device of claim 1 further comprising a rail cap located at the second end of the rail such that the rail cap prevents the weight from sliding off the second end of the rail.

4. The device of claim 1 wherein the stop is rubber or other elastomeric material.

5. The device of claim 1 wherein the stop is cylindrical with a longitudinal bore therethrough such that the rail fits within the bore of the stop.

6. The device of claim 1 further comprising a plurality of markings along the rail indicating how much force is exerted by the weight when supported at the handle.

7. The device of claim 1 wherein the weight is cylindrical.

8. A system comprising:

a rail with a threaded first end and a second end;

a stop located on the rail adjacent the threaded first end;

a plurality of handles, each with a threaded bore such that any one of the plurality of handles are configured to be removably attached to the threaded first end of the rail by screwing the handle onto the rail, wherein the handle abuts the stop when in place on the rail and wherein the plurality of handles comprises at least one puck shaped handle and at least one ball shaped handle; and a plurality of weights, wherein each weight has a longitudinal bore therethrough such that the rail fits within the longitudinal bore and any one of the plurality of weights are configured to be adjustably positioned along the rail and held in place against the rail via an attachment device;

wherein the stop is configured to prevent any one of the plurality of weights from coming into contact with the any one of the plurality of handles on the rail;

and each weight has a threaded hole extending from the weight's exterior to the longitudinal bore, wherein the threaded hole runs perpendicular to the longitudinal bore; and the attachment device is a screw appropriately sized to fit within the threaded hole such that the attachment device is configured to be tightened to press against the rail, thus securing the weight in a desired position relative to the rail, or loosened to allow the weight to slide along the rail to a desired position.

9. The system of claim 8 wherein:

the stop is removable from the rail;

each of the plurality of weights is cylindrical with the longitudinal bore therethrough such that the rail fits within the bore and the weight is slidable along the rail when not secured in place via the attachment device; and the system is capable of being used to produce a customized exercise device by removing the stop from the rail, sliding one of the weights onto the rail, replacing the stop back onto the rail, screwing one of the handles onto the first end of the rail, sliding the weight to a desired position along the rail, and securing the weight to the rail in the desired position via the attachment device.

10. The system of claim 8 wherein each of the plurality of weights has a different weight.

11. The system of claim 8 wherein each of the plurality of handles is a different size such that the plurality of handles are configured to accommodate a plurality of hand sizes.

12. The system of claim 8 further comprising a rail cap located at the second end of the rail such that the rail cap prevents the weight from sliding off the second end of the rail.

13. A method of exercise, the method comprising:

adjusting a device, the device comprising:

a rail with a first end and a second end;

a handle attached to the first end of the rail wherein the handle is puck shaped or ball shaped;

a weight, where the weight has a longitudinal bore therethrough such that the rail fits within the longitudinal bore and the weight is configured to be adjustably positioned along the rail and held in place against the rail via an attachment device; and a stop located on the rail adjacent the handle, such that the stop prevents the weight from coming into contact with the handle; and wherein the handle has a threaded bore and the first end of the rail is threaded such that the handle is configured to be removably attached to the first end of the rail by screwing the handle onto the rail;

and the weight has a threaded hole extending from the weight's exterior to the longitudinal bore, wherein the threaded hole runs perpendicular to the longitudinal bore; and the attachment device is a screw appropriately sized to fit within the threaded hole such that the attachment device is configured to be tightened to press against the rail, thus securing the weight in a desired position relative to the rail, or loosened to allow the weight to slide along the rail to a desired position;

where adjusting the device comprises adjusting the position of the weight along the rail and securing the weight in position via the attachment device;

holding the device via the handle;

performing exercises with the device;

increasing the force exerted by the device by loosening the attachment device, sliding the weight along the rail away from the handle to a new position, and securing the weight in the new position via the attachment device; and performing further exercises with the device.

14. The method of claim 13 wherein the device further comprises a plurality of markings along the rail indicating how much force is exerted by the weight when supported at the handle.

* * * * *